US009506204B2

(12) United States Patent
Blank

(10) Patent No.: US 9,506,204 B2
(45) Date of Patent: Nov. 29, 2016

(54) HOPPER BAFFLE ASSEMBLY FOR ASPHALT PAVING MACHINE

(71) Applicant: Roadtec, Inc., Chattanooga, TN (US)

(72) Inventor: Mikel A. Blank, Ooltewah, TN (US)

(73) Assignee: Roadtec, Inc., Chattanooga, TN (US)

( * ) Notice: Subject to any disclaimer, the term of this patent is extended or adjusted under 35 U.S.C. 154(b) by 0 days.

(21) Appl. No.: 14/881,794

(22) Filed: Oct. 13, 2015

(65) Prior Publication Data

US 2016/0108585 A1 Apr. 21, 2016

Related U.S. Application Data

(60) Provisional application No. 62/064,327, filed on Oct. 15, 2014.

(51) Int. Cl.

| | |
|---|---|
| ***E01C 19/00*** | (2006.01) |
| ***E01C 19/45*** | (2006.01) |
| ***E01C 19/18*** | (2006.01) |
| ***E01C 19/48*** | (2006.01) |

(52) U.S. Cl.

CPC ..... *E01C 19/45* (2013.01); *E01C 19/002* (2013.01); *E01C 19/18* (2013.01); *E01C 19/48* (2013.01); *E01C 2301/00* (2013.01)

(58) Field of Classification Search

CPC ..... E01C 19/002; E01C 19/48; E01C 18/18; E01C 19/45; E01C 2301/00

USPC ..... 404/105, 108, 118

See application file for complete search history.

(56) References Cited

U.S. PATENT DOCUMENTS

| | | | | |
|---|---|---|---|---|
| 2,658,795 | A | 10/1953 | Nicholson | |
| 2,836,332 | A | 5/1958 | Standish et al. | |
| 2,874,620 | A * | 2/1959 | Mentes | E01C 19/15 404/110 |
| 3,298,745 | A | 1/1967 | Czapiewski | |
| 3,557,672 | A * | 1/1971 | Shurtz | E01C 19/4873 404/118 |
| 3,790,090 | A | 2/1974 | Lorenc et al. | |
| 3,966,343 | A * | 6/1976 | Dick | E02B 3/121 404/101 |
| 4,566,822 | A * | 1/1986 | Miller | E02F 9/024 404/100 |
| 4,757,918 | A * | 7/1988 | Ottewell | E01C 19/2025 222/139 |
| 5,641,249 | A * | 6/1997 | McClelland | E02B 5/02 404/110 |
| 2003/0035688 | A1* | 2/2003 | Vance | E01C 19/185 404/98 |
| 2012/0282026 | A1* | 11/2012 | Atherton | E01C 19/15 404/82 |

* cited by examiner

*Primary Examiner* — Raymond W Addie

(74) *Attorney, Agent, or Firm* — Chambliss, Bahner & Stophel, P.C.

(57) ABSTRACT

An asphalt receiving hopper for an asphalt paving machine includes a left sidewall, a right sidewall, a front wall and a pair of baffle panels. The left baffle panel is resiliently attached to the left sidewall and adapted to extend into the asphalt receiving hopper, and the right baffle panel is resiliently attached to the right sidewall and adapted to extend into the asphalt receiving hopper.

18 Claims, 6 Drawing Sheets

HOPPER BAFFLE ASSEMBLY FOR ASPHALT PAVING MACHINE

CROSS-REFERENCE TO RELATED APPLICATION

This application claims the benefit of U.S. Provisional Patent Application No. 62/064,327, which was filed on Oct. 15, 2014.

FIELD OF THE INVENTION

The present invention relates generally to asphalt paving machines, and more particularly, to a modification for the asphalt receiving hopper of a paving machine that prevents asphalt material from spilling from the hopper as it is loaded by a truck or material transfer vehicle, and also facilitates conveyance of all of the asphalt material in the hopper to the distributing auger of the paving machine.

BACKGROUND OF THE INVENTION

Paving of a roadway with asphalt material is generally carried out by a paving machine that is supplied with asphalt material by a number of supply trucks and/or a material transfer vehicle. The paving machine is self-propelled and driven by a wheeled or tracked drive system. In a common type of paving machine, an asphalt receiving hopper is located at the front end of the machine to receive asphalt material from a truck or material transfer vehicle, and a hopper conveyor typically comprised of one or more slat conveyors located below the asphalt receiving hopper transfers the asphalt material from the hopper to a transverse distributing auger that is mounted near the rear of the machine. The asphalt material is deposited onto and across the roadway or other surface to be paved by the distributing auger. A floating screed located at the rear end of the machine behind the distributing auger compacts the asphalt material and forms the asphalt mat.

Asphalt material is comprised of an asphaltic binder and aggregates of various sizes, including both coarse and fine aggregate materials. Because the equipment needed to produce asphalt material is expensive and the space required extensive, asphalt material is typically produced in a production facility that is dedicated to such purpose. Consequently, it is frequently necessary to transport the asphalt material from its place of origin to a paving machine at a remote paving site. The asphalt material is transported in dump trucks to a paving machine or to a material transfer vehicle that completes the transfer to the paving machine. Frequently, asphalt material is discharged directly from the transport dump trucks into the asphalt receiving hopper of the asphalt paving machine. Because the front wall of a typical paving machine receiving hopper is low enough to allow a dump truck to dump directly into the hopper, and because the hopper of the paving machine is generally much wider than the dump body of the truck, asphalt material dumped into the hopper by a dump truck will frequently flow around the outside of the dump body and spill over the low front wall of the hopper onto the roadway. Furthermore, some of the asphalt material that flows around the outside of the dump body will accumulate in the front corners of the paving machine hopper, and this material may not be carried by the conveyor system of the paving machine out of the hopper. Asphalt material may also spill over the front wall of the hopper, and it may also accumulate in the front corners of the paving machine hopper when the hopper is loaded by a material transfer vehicle. Such material must be shoveled by hand into the hopper for transport by the hopper conveyor to the distributing auger. This material may be as hot as 300° F. (149° C.), and it can be dangerous to move it by hand shoveling. It would be desirable therefore if a hopper modification could be provided that would more readily retain asphalt material in the asphalt receiving hopper as it is discharged into the hopper in such a manner that essentially all of it is likely to be carried by the conveyor system out of the hopper to the distributing auger.

ADVANTAGES OF A PREFERRED EMBODIMENT OF THE INVENTION

Among the advantages of a preferred embodiment of the invention is that it provides a pair of baffle panels for the asphalt receiving hopper of an asphalt paving machine that are adapted to prevent asphalt material from spilling out of the hopper as it is discharged from a dump truck, and also to facilitate the conveyance of essentially all of the asphalt material in the asphalt receiving hopper to the distributing auger. Other advantages and features of this invention will become apparent from an examination of the drawings and the ensuing description.

NOTES ON CONSTRUCTION

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity.

Various terms are specifically defined herein. These terms are to be given their broadest possible construction consistent with such definitions, as follows:

The term "asphalt material(s)" refers to a bituminous paving mixture that is comprised of an asphaltic binder and any of various aggregate materials, and which is used for paving purposes.

The terms "asphalt paving machine", "paving machine" and similar terms refer to a finishing machine for applying asphalt material to form an asphalt mat on a roadway, parking lot or similar surface.

The term "paving direction", when used in describing the operation of a paving machine or the relative position of a paving machine or a component of a paving machine, refers to the direction of advance of the paving machine as the paving operation is carried out.

The term "hopper conveyor" refers to a single conveyor or to multiple parallel conveyors which are adapted to convey asphalt material from the asphalt receiving hopper of a paving machine to the distributing auger of the paving machine.

The terms "front" and "front end" of the paving machine refer to the end of the machine that leads in the paving direction. When referring to an asphalt receiving hopper or other component of the paving machine, the terms "front" and "front end" refer to that portion of the hopper or component that is nearer the front end of the paving machine.

The terms "rear" and "rear end" of the paving machine refer to the end of the paving machine opposite the front end. When referring to an asphalt receiving hopper or other component of the paving machine, the terms "rear" and "rear end" refer to that portion of the hopper or component that is nearer the rear end of the paving machine.

The terms "forward" and "in front of", as used herein to describe a relative position or direction on or in connection with a paving machine or an asphalt receiving hopper or other component of the paving machine, refer to a relative position towards the front end of the machine.

The terms "rearward", "behind" and "rearwardly", as used herein to describe a relative position or direction on or in connection with a paving machine or an asphalt receiving hopper or other component of the paving machine, refer to a relative position or direction towards the rear end of the machine.

The terms "downward" and "downwardly", as used herein to describe a relative direction on or in connection with a paving machine or an asphalt receiving hopper thereof, refer to a direction towards the roadway that is being paved by the machine.

The terms "lower" and "below", as used herein to describe the relative position of a baffle panel, or a portion or component thereof, in an asphalt receiving hopper of a paving machine, refer to a relative position that is in the downward direction.

The term "bottom", as used herein to describe a portion of an asphalt receiving hopper of a paving machine, refers to the portion in which the hopper conveyor is located. The term "bottom", as used herein to describe a portion of the sidewall of an asphalt receiving hopper, refers to the portion of the sidewall at the bottom of the hopper. The term "bottom", as used herein to describe an end of a baffle panel mounted on a sidewall of an asphalt receiving hopper, refers to the lower end.

The terms "upward" and "upwardly", as used herein to describe a relative direction on or in connection with a paving machine or an asphalt receiving hopper thereof, refer to a direction away from the roadway that is being paved by the machine.

The terms "upper" and "above", as used herein to describe the relative position of a baffle panel, or a portion or component thereof, in an asphalt receiving hopper of a paving machine, refer to a relative position that is in the upward direction.

The term "top", as used herein to describe an end of a baffle panel mounted on a sidewall of an asphalt receiving hopper, refers to the upper end.

The term "right", when used herein to describe a relative position or direction on or in connection with a paving machine, or an asphalt receiving hopper or other component thereof, refers to the right side of the machine, hopper or component from the perspective of an observer facing the paving direction.

The term "left", when used herein to describe a relative position or direction on or in connection with a paving machine or an asphalt receiving hopper or other component thereof, refers to the left side of the machine, hopper or component from the perspective of an observer facing the paving direction.

The term "vertical", when used herein to describe a relative orientation of the walls of an asphalt receiving hopper or a baffle panel mounted therein, refers to a position or direction along a line that is generally perpendicular to the plane formed by the hopper conveyor in the bottom of the hopper.

The term "width", when used herein to describe a dimension of an asphalt receiving hopper or a baffle panel for a hopper, or to describe a dimension of an associated dump body of an asphalt transport truck, refers to a dimension that is measured from a sidewall of the asphalt receiving hopper in a direction towards the opposite sidewall of the hopper which is perpendicular to the paving direction.

The term "height", when used herein to describe a dimension of a wall of an asphalt receiving hopper, refers to a dimension measured from the bottom of the wall to the top in a generally vertical direction. The term "height", when used herein to describe a dimension of a baffle panel for an asphalt receiving hopper, refers to the length of the baffle panel measured along the plane of the sidewall to which it is attached.

The term "resiliently attached", when used herein to describe the attachment of the baffle panel to the sidewall of an asphalt receiving hopper, refers to either or both of the means of attachment of the baffle panel and the composition of the baffle panel. A baffle panel that is "resiliently attached" to a sidewall is adapted to deflect, pivot, flex or bend upon being contacted by the end wall or sidewalls of a dump body of a dump truck.

SUMMARY OF THE INVENTION

The invention comprises a pair of baffle panels that are adapted to be resiliently attached to the opposite sidewalls of an asphalt receiving hopper behind the front wall of the hopper. Each baffle panel will extend from the sidewall to which it is attached into the interior of the asphalt receiving hopper. Preferably, the width of each baffle panel is somewhat larger than one-half the difference between the width of the asphalt receiving hopper and the width of a typical dump body, and the height of each baffle panel is greater than the height of the front wall of the hopper.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which.

DESCRIPTION OF THE PREFERRED EMBODIMENTS OF THE INVENTION

Figure 1:
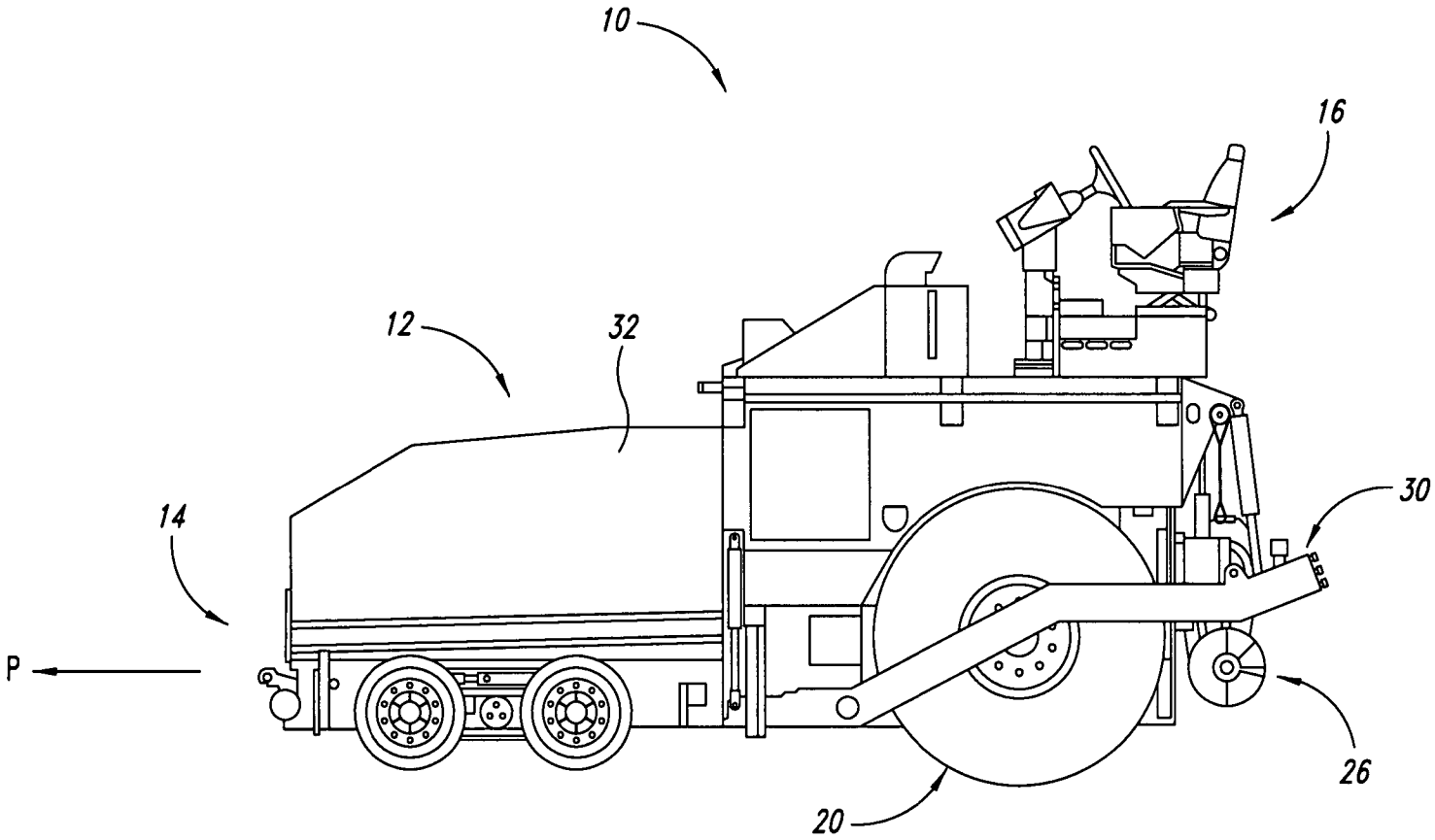
FIG. 1 is a side view of a paving machine to which the invention (not shown in FIG. 1) may be mounted.
Figure 2:
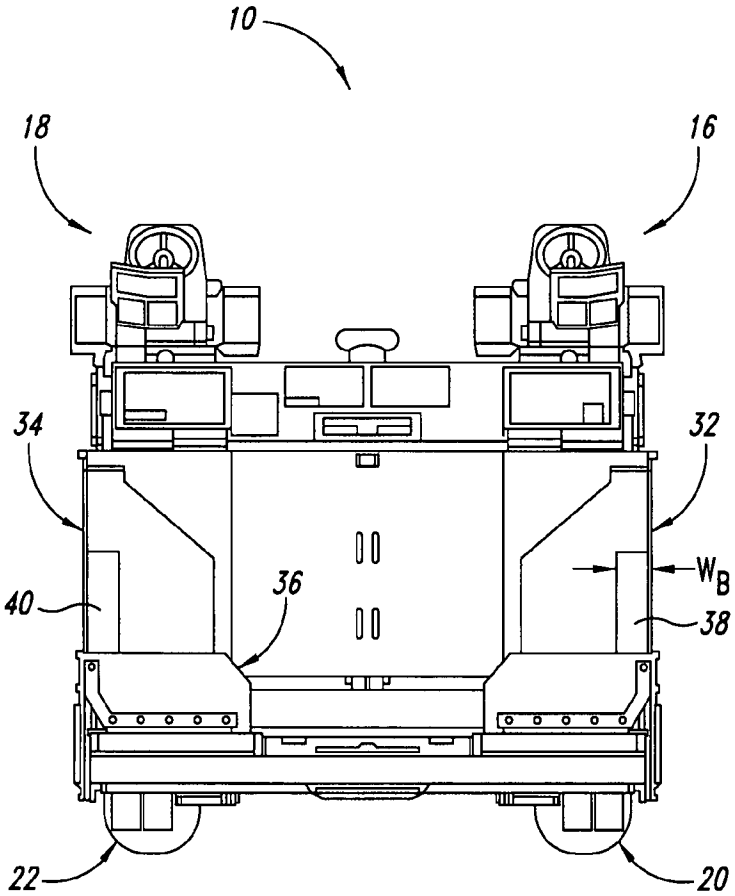
FIG. 2 is a front view of the paving machine shown in FIG. 1, showing a pair of baffle panels of a first embodiment in the asphalt receiving hopper.
Figure 3:
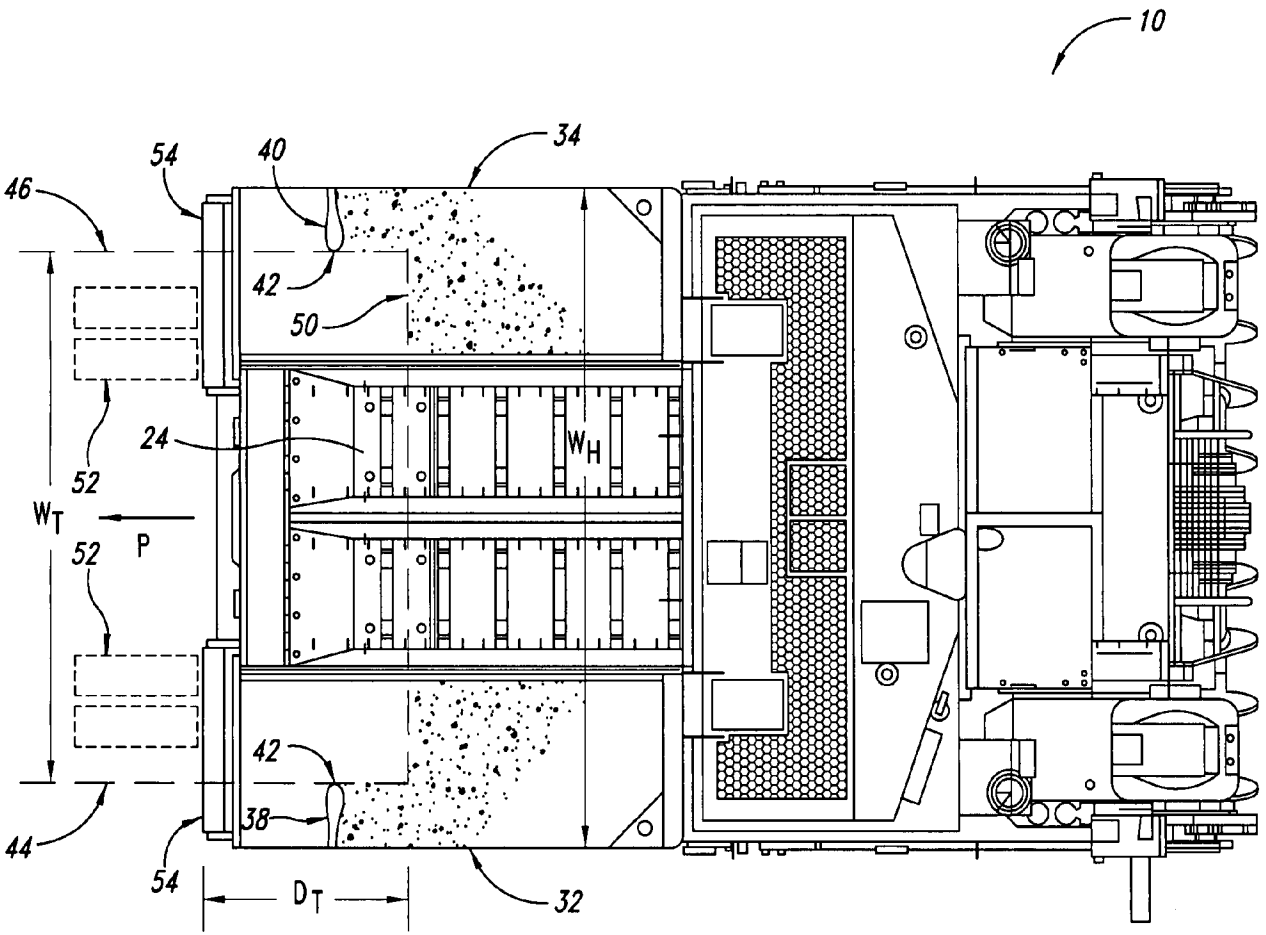
FIG. 3 is a top view of the paving machine shown in FIGS. 1 and 2.

Referring now to the drawings, FIGS. 1-3 illustrate paving machine 10, which includes asphalt receiving hopper 12 at its front end 14 for receiving asphalt material from a dump truck or material transfer vehicle. Paving machine 10 also includes left operator's station 16 and right operator's station 18. A pair of drive wheels 20 and 22 are driven by an engine (not shown) so as to move the paving machine during the paving operation in the paving direction indicated by arrow P. The bottom of asphalt receiving hopper 12 is open, exposing hopper conveyor 24 mounted below the hopper. Conveyor 24 transports asphalt material from asphalt receiving hopper 12 through a conveyor tunnel under the engine and operator's stations to transverse distributing auger 26 that is located near rear end 28 of paving machine 10. Transverse distributing auger 26 is adapted to distribute the asphalt material received from the hopper across the width of the roadway or lane to be paved. A floating screed (not shown) is attached to the paving machine by a pair of tow arms, one of which, tow arm 30, is illustrated in FIG. 1. The screed serves to compact the asphalt material and form an asphalt mat on the roadway.

Asphalt receiving hopper 12 is defined by left sidewall 32, right sidewall 34 and front wall 36. A baffle panel is resiliently attached to each sidewall of the hopper so that it extends into the hopper. Preferably, the baffle panels are located directly opposite each other across the width of the hopper. It is also preferred that each baffle panel is mounted at a right angle with respect to the sidewall to which it is attached. In some embodiments of the invention, each baffle panel is oriented generally vertically with respect to the hopper conveyor. In other embodiments of the invention, each baffle panel may be mounted to the sidewall at an angle θ from the vertical. In some embodiments of the invention, each baffle panel is angled from the vertical with its top or upper end farther from the front of the asphalt receiving hopper than its bottom or lower end. In some embodiments of the invention, the lower end of each baffle panel is at the bottom of the sidewall to which it is attached. In other embodiments of the invention, the lower end of each baffle panel is raised above the bottom of the sidewall to which it is attached to allow for shovel access below the baffle panel. In some embodiments of the invention, the lower end of each baffle panel is raised by an amount within the range of 15-25 cm above the bottom of the sidewall to which it is attached.

Each baffle panel may be formed of a generally rigid material and be mounted with a spring-loaded hinge to the sidewall of the hopper so that it extends into the hopper and is adapted to deflect or pivot upon being contacted by the end wall or sidewalls of a dump body of a dump truck. Baffle panels of this type may be made, for example, of metal, wood or plastic such as ultra-high molecular weight polyethylene ("UHMWPE"). In the alternative, each baffle panel may be formed of a non-rigid or flexible material and fixed to the sidewalls of the hopper so that the panel extends into the hopper and is adapted to flex or bend upon being contacted by the end wall or sidewalls of a dump body of a dump truck. Baffle panels of this type may be made, for example, of rubber.

A first embodiment of the invention is illustrated in FIG. 2. As shown therein, baffle panel 38 is attached to left sidewall 32 and baffle panel 40 is attached to right sidewall 34. These baffle panels are made of flexible material and fixed to the sidewalls of the hopper using brackets (not shown) or other means of attachment known to those having ordinary skill in the art. These baffle panels are mounted generally vertically with respect to the sidewalls to which they are attached. Baffle panels 38 and 40 are also contoured to provide a reinforced end 42 away from the hopper sidewall. Because these baffle panels are made of non-rigid or flexible material, they will flex or bend when contacted by the end wall or sidewalls of the dump body of a dump truck.

Figure 5:
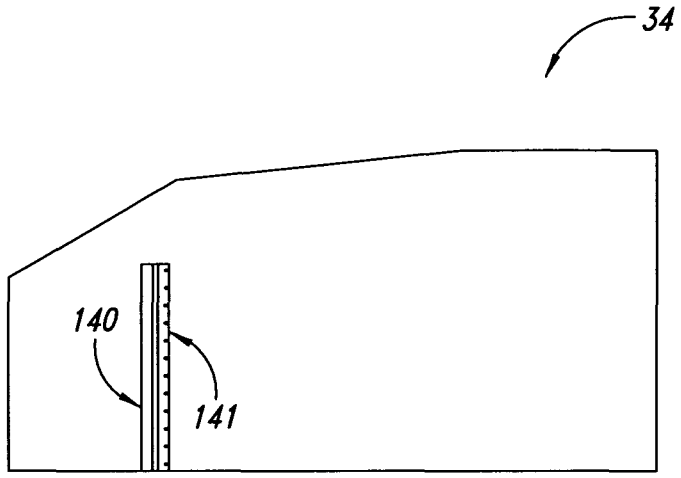
FIG. 5 is a plan view of a sidewall of the asphalt receiving hopper of a paving machine showing a baffle panel of a second embodiment mounted thereon.
Figure 6:
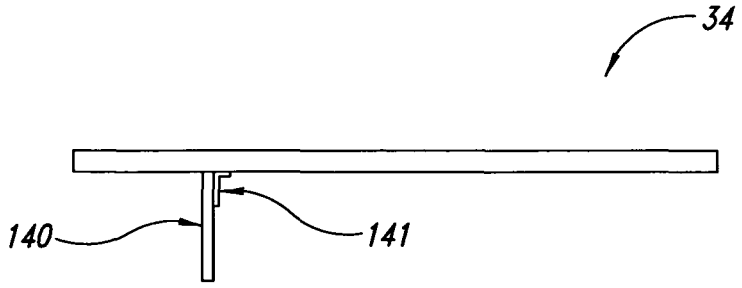
FIG. 6 is a top view of the sidewall and baffle panel shown in FIG. 5.

A second embodiment of a baffle panel is illustrated in FIGS. 5 and 6. As shown therein, rigid planar baffle panel 140 is attached to right sidewall 34 by means of spring-loaded hinge 141. These baffle panels are mounted generally vertically with respect to the sidewalls to which they are attached, with their bottom ends at the bottom of the sidewall. Because baffle panels of this type are attached to the sidewalls of the asphalt receiving hopper by spring-loaded hinges, they will pivot or move when contacted by the end wall and sidewalls of the dump body of a dump truck.

Figure 7:
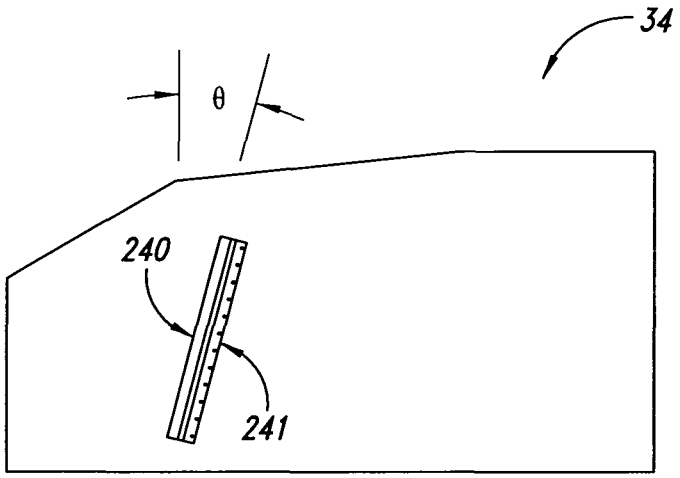
FIG. 7 is a plan view of a sidewall of the asphalt receiving hopper of a paving machine showing a baffle panel of a third embodiment mounted thereon.
Figure 8:
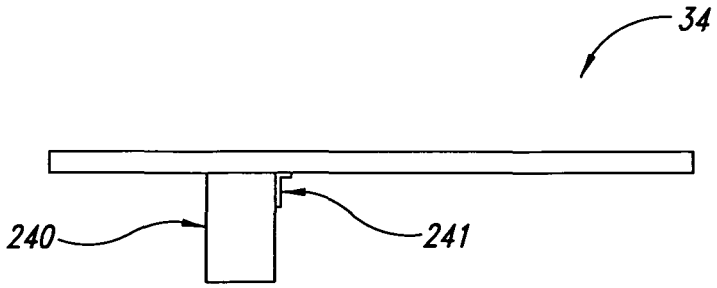
FIG. 8 is a top view of the sidewall and baffle panel shown in FIG. 7.

A third embodiment of a baffle panel is illustrated in FIGS. 7 and 8. As shown therein, rigid planar baffle panel 240 is attached to right sidewall 34 by means of spring-loaded hinge 241 at an angle θ from the vertical. Preferably, θ is in the range of 5°-25°, most preferably about 15° from the vertical. The mounting of baffle panel 240 on sidewall 34 at an angle θ from the vertical places its top or upper end farther from the front of the asphalt receiving hopper than its bottom or lower end. In this embodiment of the invention, the lower end of baffle panel 240 is raised above the bottom of the sidewall to which it is attached to allow for shovel access below the baffle panel, as shown in FIG. 7.

In other embodiments of the invention, contoured baffle panels may be made of rigid material and attached to the sidewalls using spring-loaded hinges or other means of resilient attachment known to those having ordinary skill in the art. In still other embodiments of the invention, planar baffle panels may be made of flexible materials and fixed to the sidewalls with brackets or other means of fixed attachment. In other embodiments of the invention, the baffle panels may extend into the asphalt receiving hopper at angles other than 90°, or they may be oriented other than generally vertically, or they may be mounted at locations other than directly opposite each other across the width of the hopper.

Asphalt receiving hopper 12 is wider than a typical dump truck body. The maximum width (without requiring a special permit) of a dump body for a truck operating on public roadways is 2.6 meters in Canada and in all U.S. states except Hawaii (where it is 2.74 meters). Similarly, the maximum width (without requiring a special permit) of a dump body for a truck operating on public roadways in most European countries is 2.55 meters. As shown in FIG. 3, an outline of a typical dump truck body is indicated by left sidewall 44, right sidewall 46 and end wall 50. Because it is desirable to unload a dump truck while paving is being carried out (i.e., without stopping the paving machine), a dump truck is typically positioned to discharge its load of asphalt material into an asphalt receiving hopper such as hopper 12 in such a way that rear tires 52 of the truck will abut rollers 54 on the front end of the paving machine. The truck will then raise its bed and begin to discharge its load of asphalt material into the asphalt receiving hopper as the paving machine moves in the paving direction, pushing the truck in front of it as the truck continues to unload and paving continues.

As shown in FIG. 3, the width $W_H$ of asphalt receiving hopper 12 may be as much as 25% greater than the width $W_T$ of the dump body. Preferably, the width of each baffle panel is somewhat larger than one-half the difference between the width of the hopper and the width of a typical dump body, although FIG. 3 shows baffle panels 38 and 40 each having a width that is approximately equal to one-half the difference between the width of the hopper and the width of a typical truck dump body. Most preferably, the width of each baffle $W_B=1.2\ [(W_H-W_T)/2]$, in order to allow for variations in the positioning of dump trucks by their drivers with respect to the hopper of the paving machine. Consequently, if $W_H=3.25$ meters and $W_T=2.55$ meters (i.e., for trucks commonly used in Europe), the preferred baffle panel width $W_B$ would be 1.2 [(3.25−2.55)/2]=0.42 meters or 42 cm. Similarly, if $W_H=3.25$ meters and $W_T=2.6$ meters (i.e., for trucks commonly used in Canada and most states of the United States), the preferred baffle panel width $W_B$ would be 1.2 [(3.25−2.6)/2]=0.39 meters or 39 cm. Finally, if $W_H=3.25$ meters and $W_T=2.74$ meters (i.e., for trucks commonly in use in Hawaii), the preferred baffle panel width $W_B$ would be 1.2 [(3.25−2.74)/2]=0.306 meters or 30.6 cm.

Figure 4:
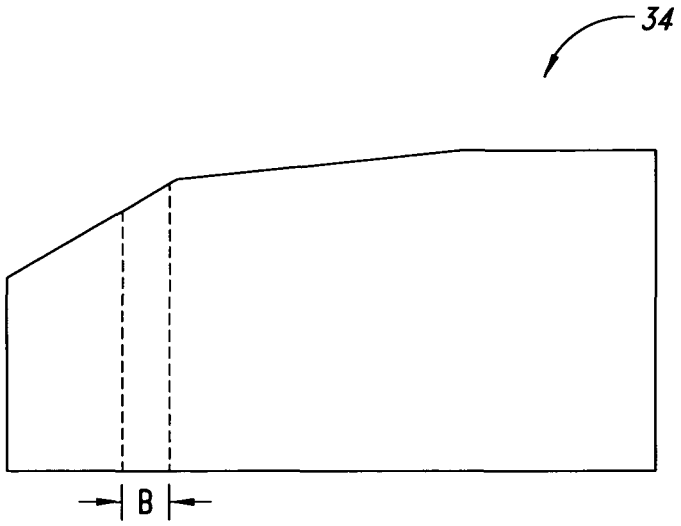
FIG. 4 is a plan view of a sidewall of the asphalt receiving hopper of a paving machine showing the preferred location for a baffle panel.

Generally, the width of each baffle panel will be within the range of 25-45 cm. Preferably, the height of each baffle panel is greater than the height of the front wall of the hopper, and most preferably approximately twice the height of the front wall of the hopper. Generally, the height of each baffle panel will be at least about 50 cm. It is also preferred that each baffle be located within a baffle zone B (see FIG. 4) that is located behind the front wall of the hopper a distance $D_B$ that is within the range of 50-80% of $D_T$, the distance from the back of the rear tires of the truck to the end wall 50 of the dump body, typically about 40-60 cm behind the front wall of the hopper.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations as would be appreciated by those having ordinary skill in the art to which the invention relates.

What is claimed is:

1. An asphalt receiving hopper for an asphalt paving machine comprising:

(a) a left sidewall;

(b) a right sidewall;

(c) a front wall;

(d) a left baffle panel that is resiliently attached to the left sidewall and adapted to extend into the asphalt receiving hopper;

(e) a right baffle panel that is resiliently attached to the right sidewall and adapted to extend into the asphalt receiving hopper wherein said baffle panels are configured to contact a dump body of a dump truck when asphalt material is added into the hopper.

2. The asphalt receiving hopper of claim 1 wherein:

(a) the width of the left baffle panel is within the range of 25-45 cm;

(b) the width of the right baffle panel is within the range of 25-45 cm.

3. The asphalt receiving hopper of claim 1, which is adapted to receive asphalt material from a truck having a dump body of known width $W_T$, wherein:

(a) the asphalt receiving hopper has a known width $W_H$; and (b) the width of the left baffle panel equals 1.2 $[(W_H-W_T)/2]$; and (c) the width of the right baffle panel equals 1.2 $[(W_H-W_T)/2]$.

4. The asphalt receiving hopper of claim 1 wherein:

(a) the height of the left baffle panel is at least about 50 cm;

(b) the height of the right baffle panel is at least about 50 cm.

5. The asphalt receiving hopper of claim 1 wherein:

(a) the height of the left baffle panel is approximately twice the height of the front wall of the asphalt receiving hopper;

(b) the height of the right baffle panel is approximately twice the height of the front wall of the asphalt receiving hopper.

6. The asphalt receiving hopper of claim 1, which is adapted to receive asphalt material from a truck having a plurality of rear tires and a dump body with an end wall that is a known distance $D_T$ from the back of the rear tires, wherein:

(a) the left baffle panel is located on the left sidewall of the asphalt receiving hopper a distance $D_B$ from the front wall of the asphalt receiving hopper that is 50-80% of $D_T$;

(b) the right baffle panel is located on the right sidewall of the asphalt receiving hopper a distance $D_B$ from the front wall of the asphalt receiving hopper that is 50-80% of $D_T$.

7. The asphalt receiving hopper of claim 1 wherein:

(a) the left baffle panel is located on the left sidewall of the asphalt receiving hopper a distance $D_B$ behind the front wall of the asphalt receiving hopper that is within the range of 40-60 cm;

(b) the right baffle panel is located on the right sidewall of the asphalt receiving hopper a distance $D_B$ behind the front wall of the asphalt receiving hopper that is within the range of 40-60 cm.

8. The asphalt receiving hopper of claim 1 wherein the left baffle panel is located directly opposite the right baffle panel.

9. The asphalt receiving hopper of claim 1 wherein:

(a) the left baffle panel is mounted on the left sidewall of the asphalt receiving hopper so as to form a right angle therewith;

(b) the right baffle panel is mounted on the right sidewall of the asphalt receiving hopper so as to form a right angle therewith.

10. The asphalt receiving hopper of claim 1 wherein:

(a) the left baffle panel is mounted on the left sidewall of the asphalt receiving hopper and oriented generally vertically with respect to the bottom of the asphalt receiving hopper;

(b) the right baffle panel is mounted on the right sidewall of the asphalt receiving hopper and oriented generally vertically with respect to the bottom of the asphalt receiving hopper.

11. The asphalt receiving hopper of claim 1 wherein:

(a) the left baffle panel is mounted on the left sidewall of the asphalt receiving hopper with its lower end raised above the bottom of the left sidewall;

(b) the right baffle panel is mounted on the right sidewall of the asphalt receiving hopper with its lower end raised above the bottom of the right sidewall.

12. The asphalt receiving hopper of claim 1 wherein:

(a) the left baffle panel is mounted on the left sidewall of the asphalt receiving hopper with its lower end raised above the bottom of the left sidewall by an amount within the range of 15-25 cm;

(b) the right baffle panel is mounted on the right sidewall of the asphalt receiving hopper with its lower end raised above the bottom of the right sidewall by an amount within the range of 15-25 cm.

13. The asphalt receiving hopper of claim 1, which is adapted to receive asphalt material from a truck having dump body with an end wall and left and right sidewalls, wherein:

(a) the left baffle panel is formed of a generally rigid material and is mounted with a spring-loaded hinge to the left sidewall of the asphalt receiving hopper so that it extends into the asphalt receiving hopper and is adapted to deflect or pivot upon being contacted by the end wall or sidewalls of the dump body of the truck;

(b) the right baffle panel is formed of a generally rigid material and is mounted with a spring-loaded hinge to the right sidewall of the asphalt receiving hopper so that it extends into the asphalt receiving hopper and is adapted to deflect or pivot upon being contacted by the end wall or sidewalls of the dump body of the truck.

14. The asphalt receiving hopper of claim 1, which is adapted to receive asphalt material from a truck having dump body with an end wall and left and right sidewalls, wherein:

(a) the left baffle panel is formed of a non-rigid material and is fixed to the left sidewall of the asphalt receiving hopper so that it extends into the asphalt receiving hopper and is adapted to flex or bend upon being contacted by the end wall or sidewalls of the dump body of the truck;

(b) the right baffle panel is formed of a non-rigid material and is fixed to the right sidewall of the asphalt receiving hopper so that it extends into the asphalt receiving hopper and is adapted to flex or bend upon being contacted by the end wall or sidewalls of the dump body of the truck.

15. The asphalt receiving hopper of claim 1 wherein:

(a) the left baffle panel is mounted on the left sidewall of the asphalt receiving hopper and oriented at an angle within the range of 5°-25° with respect to the vertical;

(b) the right baffle panel is mounted on the right sidewall of the asphalt receiving hopper and oriented at an angle within the range of 5°-25° with respect to the vertical.

16. The asphalt receiving hopper of claim 15, wherein:

(a) the left baffle panel is oriented on the left sidewall such that its upper end is farther from the front of the asphalt receiving hopper than its lower end;

(b) the right baffle panel is oriented on the right sidewall such that its upper end is farther from the front of the asphalt receiving hopper than its lower end.

17. The asphalt receiving hopper of claim 1 wherein:

(a) the left baffle panel is mounted on the left sidewall of the asphalt receiving hopper and oriented at an angle of about 15° with respect to the vertical;

(b) the right baffle panel is mounted on the right sidewall of the asphalt receiving hopper and oriented at an angle of about 15° with respect to the vertical.

18. The asphalt receiving hopper of claim 17, wherein:

(a) the left baffle panel is oriented on the left sidewall such that its upper end is farther from the front of the asphalt receiving hopper than its lower end;

(b) the right baffle panel is oriented on the right sidewall such that its upper end is farther from the front of the asphalt receiving hopper than its lower end.

* * * * *